US005799911A

United States Patent [19]

Dostie et al.

[11] Patent Number: 5,799,911

[45] Date of Patent: Sep. 1, 1998

[54] DISPLAY STAND FOR WRIST WATCHES

[75] Inventors: Alain Dostie, Ile Bizard; Allan Sandler, Dollard des Ormeaux, both of Canada

[73] Assignee: Algar Plastics (Canada) Ltd., St-Laurent, Canada

[21] Appl. No.: 600,895

[22] Filed: Feb. 13, 1996

[51] Int. Cl.[6] ..... A47F 7/00

[52] U.S. Cl. ..... 248/116; 206/301; 206/566; 368/316

[58] Field of Search ..... 248/116, 115, 248/114, 228.7, 231.81, 229.16, 300; 368/316, 317; 206/6.1, 18, 301, 566

[56] References Cited

U.S. PATENT DOCUMENTS

| | | | |
|---|---|---|---|
| D. 328,537 | 8/1992 | Edwards | D6/466 |
| 1,372,205 | 3/1921 | Smith | 248/229.16 |
| 2,073,172 | 3/1937 | Posnack | 248/229.16 |
| 2,549,369 | 4/1951 | Epstein | 248/116 |
| 4,034,849 | 7/1977 | Zakrajsek | 206/301 |
| 4,082,183 | 4/1978 | Sturm | 206/301 |
| 4,216,858 | 8/1980 | Beauchamp | 206/45.15 |
| 4,650,077 | 3/1987 | Droz | 206/566 |
| 4,707,146 | 11/1987 | Wein | 368/316 |
| 4,799,588 | 1/1989 | Trisl | 206/301 |
| 4,830,181 | 5/1989 | Hartman | 206/45.19 |
| 5,136,557 | 8/1992 | Plawker et al. | 368/316 |
| 5,181,608 | 1/1993 | Herzog | 206/801 |
| 5,377,822 | 1/1995 | Herzog | 206/45.14 |

FOREIGN PATENT DOCUMENTS

| | | |
|---|---|---|
| 311997 | 5/1919 | Germany . |

*Primary Examiner*—Ramon O. Ramirez
*Assistant Examiner*—Anita M. King
*Attorney, Agent, or Firm*—Mathews, Collins, Shepherd & Gould

[57] ABSTRACT

A display stand for wrist watches capable of accommodating wristbands of different dimensions is provided. The display stand comprises a base portion and a support portion mounted to the base portion and having three areas of contact with the wristband of a watch and also comprises a connecting member connecting two of the contact areas to one another. The connecting member comprises a hinge-like portion that allows two of the three contact areas to move relative to one another to accommodate the dimension of the wristband and comprises means to urge these two contact areas toward their initial position. In a preferred embodiment, the connecting member is a generally V-shaped resilient member whose vertex constitutes the hinge-like portion.

8 Claims, 2 Drawing Sheets

DISPLAY STAND FOR WRIST WATCHES

FIELD OF THE INVENTION

The present invention relates to the field of display stands for wrist watches and more particularly, to a display stand capable of accommodating wristbands of different dimensions.

BACKGROUND TO THE INVENTION

It is conventional to employ small individual stands to display wrist watches in a way that is more aesthetically pleasing and space-effecient. Those stands also allow watches to be displayed at a proper angle and to be easily manipulated. A typical prior art display stand comprises a generally C-shaped holder that engages a wrist watch over a continuous section. Such display stands do not, however, possess sufficient flexibility to fit wrist watches with widely varying wristband dimensions. Consequently, a retailer must purchase such display stands in various sizes to accommodate the different sizes of the wristwatches to be displayed.

OBJECT AND STATEMENT OF THE INVENTION

It is therefore an object of the present invention to provide a wristwatch display stand capable of accommodating wristbands of various dimensions such as clasped wristbands.

As embodied and broadly described herein, the invention provides a display stand adapted to support clasped wrist watches having different wristband dimensions, the display stand comprising:

a) a base portion;

b) a support portion mounted to the base portion, the support portion comprising a first contact area and a second contact area, the first and second contact areas being capable of acquiring either one of a first and a second position relative to one another, the first and second contact areas being connected together via a connecting member comprising a hinge-like portion, the connecting member further comprising a third contact area and means to urge the first and second contact areas toward the first position, the first, second and third contact areas defining together a support for holding the wristband of a wrist watch, whereby the hinge-like member allows the first and second contact areas to move relative to one another to acquire the second position to accommodate the dimension of the wristband and whereby upon removal of the wristband, the first and second contact areas return to the first position.

In preferred embodiments, the connecting member is a generally V-shaped resilient member whose vertex constitutes the third connecting member and hinge-like portion.

As embodied and broadly described herein, the invention also provides a display stand for wrist watches having different wristband dimensions such as clasped wristbands, the display stand comprising a support portion mounted to a base portion, the support portion comprising a first contact area and a second contact area, the first and second contact areas being connected together via a generally V-shaped resilient member comprising a third contact area, the first and second contact areas being capable of acquiring either one of a first and a second position relative one another, the first, second and third contact areas defining together a support for holding the wristband of a wrist watch, whereby the resilient V-shaped member allows the first and second contact areas to move relative one another to acquire the second position to accommodate the wristband and whereby upon removal of the wristband, the first and second contact areas return to the first position.

In a preferred embodiment, the first and second contact areas are curvilinear. In another embodiment, the third contact area is defined by the apex of the V-shaped member. In another variant, the base portion comprises either one of a male or female engaging member adapted to receive a corresponding female or male engaging member located on a display tray.

As embodied and broadly described herein, the invention also provides a display stand for wrist watches having different wristband dimensions, such as clasped wristbands, the display stand comprising a support portion mounted to a base portion, the support portion comprising a first generally cylindrical member and a second generally cylindrical member, the first and second cylindrical members being bonded to a generally V-shaped resilient plastic member comprising a contact area, the first and second cylindrical members being capable of acquiring either one of a first and a second position relative one another, the first and second cylindrical member defining together with the contact area a support for holding the wristband of a wrist watch, whereby the resilient V-shaped member allows the first and second cylindrical members to move relative one another to acquire the second position to accommodate the dimension of the wristband and whereby upon removal of the wristband, the first and second cylindrical members return to the first position.

In the context of the present specification, the expression "hinge-like portion" is used to define a specific portion of the connecting member, that permits the movement of the first and second contact areas relative one another, as opposed to the entire length of the connecting member. In other words, it is the hinge-like portion that permits the relative movement of the first and second contact areas and not, for example, the inherent flexibility of the entire connecting member. The expression "hinge-like portion" should however not be interpreted as meaning that the connecting member does not possess any inherent flexibility but also extends, in such cases, to an area of increased flexibility. Similarly, the word "hinge" is not limited to a jointed mechanical device but extends to anything that accomplishes the same function.

Other objects and features of the invention will become apparent by reference to the following specification and to the drawings.

BRIEF DESCRIPTION OF THE DRAWINGS

The following is a description by way of a preferred embodiment, reference being made to the following drawings, in which.

DESCRIPTION OF A PREFERRED EMBODIMENT

Figure 1:
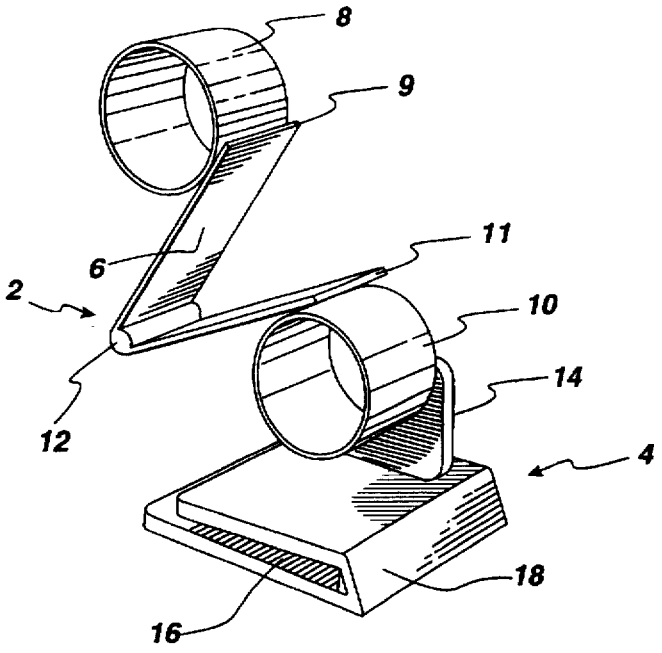
FIG. 1 is a perspective view of the display stand in accordance with a preferred embodiment of the present invention.

Referring now to FIG. 1, there is shown a display stand for a wrist watch comprising a support portion generally referred to at 2 and a base portion generally referred to at 4.

The support portion 2 comprises a connecting member 6. The connecting member 6 may consist of a generally V-shaped member comprising a first end 9 and a second end 11 and whose vertex 12 constitutes a third contact area, the first and second contact areas being described hereinafter. In this particular embodiment, the vertex 12 and surrounding area define a hinge-like portion that permits the first and second contact areas to move relative to one another as explained in greater details below. The connecting member 6 may be formed by any conventional moulding techniques and may be made from a suitable plastic material such as acrylic. Other materials may be used as long as they provide the hinge-like portion of the connecting member with sufficient flexibility to allow the first and second contact areas 8 and 10 to move relative to one another, without breaking, as described hereinafter. As to the resiliency requirements, the connecting member 6 should be capable of being flexed for a prolonged period of time, i.e. many days or weeks, without showing any substantial permanent deformation or substantial loss of resiliency. As previously mentioned, a connecting member made of acrylic has proven satisfactory.

A first contact area 8 and a second contact area 10 are located at first end 9 and at second end 11 respectively of the connecting member 6. The first, second and third contact areas 8, 10 and 12 defining together a support for holding the wristband of a watch.

In the described embodiment, the first contact area 8 and the second contact area 10 consist of two cylindrical members that are secured to the first and second ends 9 and 11 of the V-shaped connecting member, by means of a suitable adhesive. One of the advantages of having such cylindrical members is that they provide curvilinear contact areas that reduce the wear on the wristband.

In another embodiment (not shown), the curvilinear first and second contact areas are integrally formed with the first and second ends of the resilient connecting member 6. In another embodiment, which may be used in connection with metal or similar wristbands, the first and second contact areas may be defined by the first and second ends of the resilient connecting member 6. Since the ends of the connecting member 6 may relatively sharp, such an embodiment is however not recommended in the case of leather or other fragile wristbands which could be abraded or damaged.

The support portion 2 is mounted to a base portion 4 in any suitable manner. As shown in FIG. 1, the support portion may be mounted to the base portion by means of a flange member 14 that is secured to the base 4 on one side and to the support portion on the other side. The flange member 14 may be secured to the base portion and to the support portion by using any conventional adhesives. Although in the present embodiment, the support portion 2 is mounted to the base portion 4 using flange member 14, other means may be available. In order to achieve the best visibility, the support portion 2 is mounted to the base portion 4 at an angle.

The front part of the base portion 4 comprises a display area 18 that allows the user to convey information, such as trade-mark, model, price, etc, to the eventual purchaser. The display area 18 is also angled so that the information is easily visible when the watch is being displayed.

Figure 2:
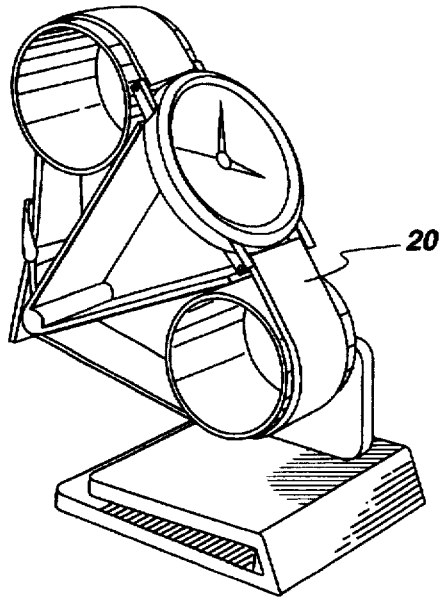
FIG. 2 is a perspective view of the display stand according to FIG. 1 and displaying a wrist watch.

In order to display a wristwatch, the user simply forces the first and second contact areas 8 and 10 towards one another from a first "at rest" relative position to a second relative position and encircles the support defined by the first, second and third contact areas 8, 10 and 12 with the wristband. Upon release of the force, the resiliency of the connecting member 6 prompts the first and second contact areas 8 and 10 to return to their original position where they engage the wristband 20 of the watch. The pressure exerted on the wristband by the first and second contact areas will then maintain it in place as shown in FIG. 2.

Figure 3:
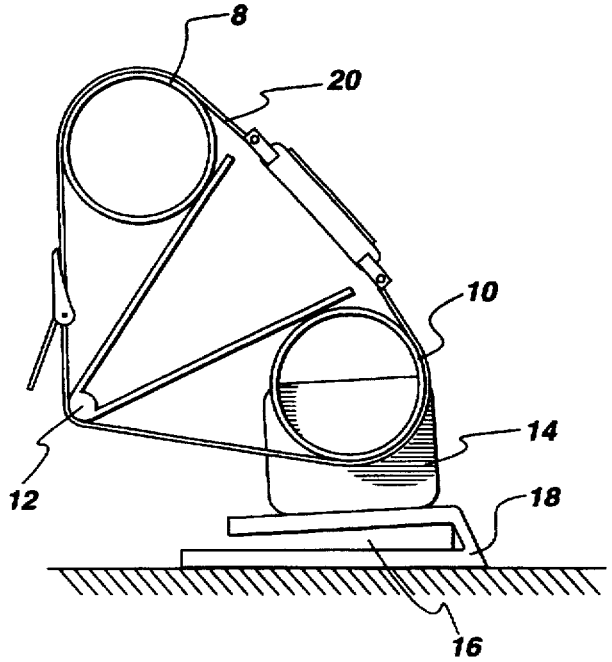
FIGS. 3 and 4 are side elevational views of the display stand according to FIG. 1 and displaying wrist watches having different wristband dimensions.
Figure 4:
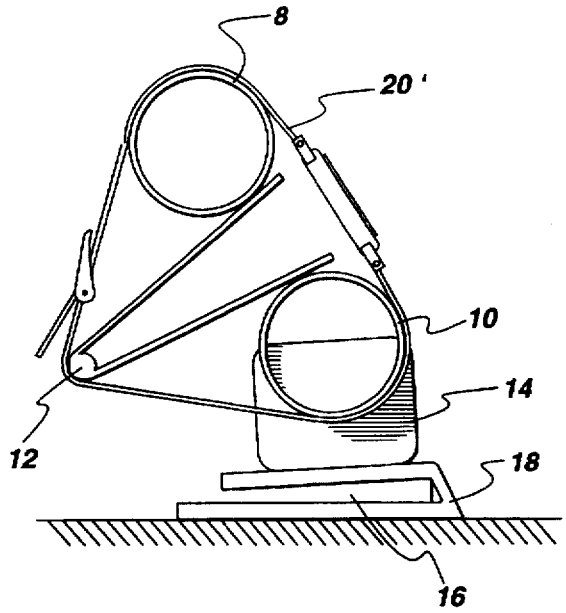

The hinge-like portion of the connecting member 6 thus allows the first and second contact areas 8 and 10 to move relative one another in order to accommodate wristbands having varying dimensions such as, for example, watches having clasped wristbands. This is shown more particularly in FIGS. 3 and 4 which illustrate a display stand according to a preferred embodiment of the invention displaying watches having wristbands 20 and 20' of different dimensions.

In the present embodiment, the connecting member 6 is made of a suitable resilient plastic and thus, its vertex 12 possesses sufficient inherent flexibility to constitute the hinge-like portion of the connecting member. It is however possible to provide a connecting member which is not flexible and to provide any type of hinge-like portion as long as that portion allows the first and second contact areas to move relative to one another. Similarly, it is also possible to provide a connecting member which is somewhat flexible and to provide a hinge-like portion which is more flexible than the connecting member.

In the described embodiment, the inherent resiliency of the connecting member 6 constitutes the means to urge the first and second contact areas toward the first relative position. However, it is possible to provide a connecting member which is not inherently resilient and to provide mechanical means, such as a spring, to urge the first and second contact areas toward the first relative position.

Figure 5:
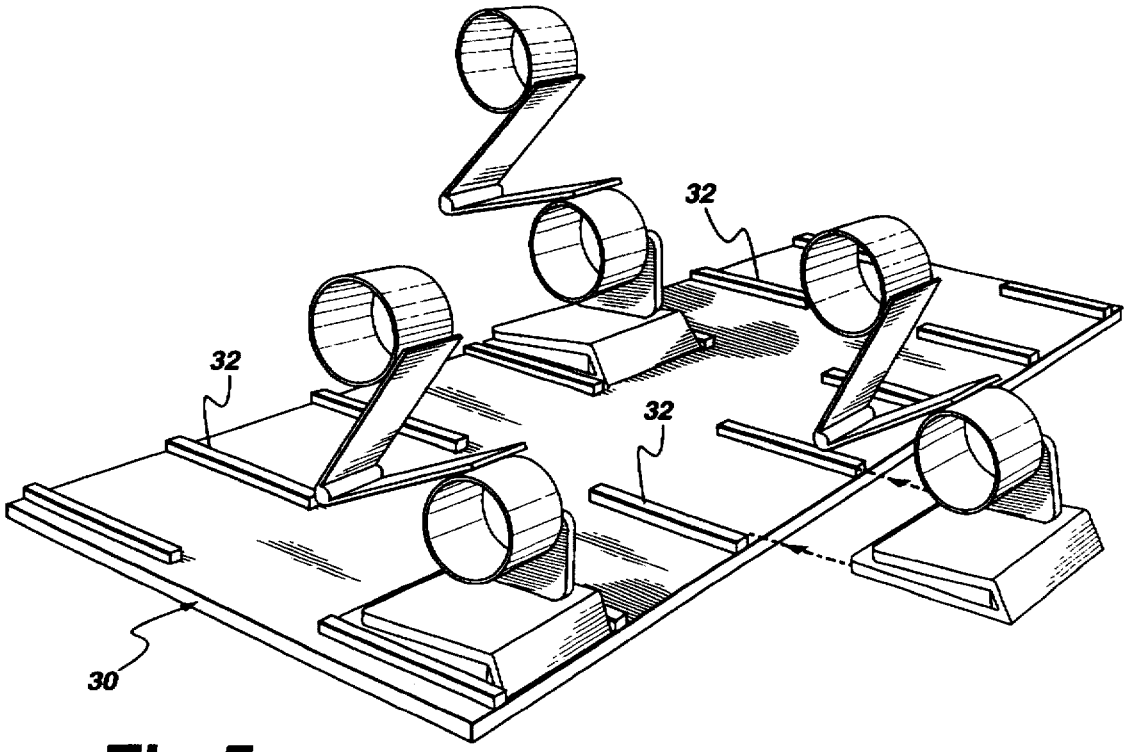
FIG. 5 is a perspective view of the display tray comprising a plurality of display stands.

The display stands according to the present may be removably mounted on a display tray 30 shown in FIG. 5 comprising a plurality of such stands. In order to allow the display stands to be mounted on the tray, the base portion is provided with a female engaging member such as recess 16 that is adapted to receive a corresponding male engaging member on the display tray, such as a projection 32. The provision of the male/female engaging members on the base portion and on the tray will allow the user to transport a plurality of display stands with greater ease while preventing them from moving relative to one another.

The display stand according to the invention thus has the advantage of being capable of accommodating various wristbands dimensions.

The above description of a preferred embodiment should not be interpreted in any limiting manner since variations and refinements are possible which are within the spirit and scope of the present invention. The scope of the invention is defined in the appended claims and their equivalents.

The embodiments of the invention for which an exclusive property or privilege is claimed are defined as follows:

1. A display stand adapted to support wrist watches having different wristband dimensions, said display stand comprising:

(a) a base portion;

(b) a support portion mounted to said base portion, said support portion including:

(i) a first contact area;

(ii) a second contact area, the first contact area and the second contact area being capable of acquiring a first relative position and a second relative position with respect to each other;

(iii) a connecting member connecting the first contact area and the second contact area, the connecting member including:

(1) a hinge-like portion, (2) a third contact area, and (3) means for urging the first contact area and the second contact area from the second relative position towards the first relative position;

the first contact area, second contact area and the third contact area together defining a support for holding the wristband of the wrist watch when the wristband is clasped, whereby when the first contact area and the second contact area are urged from the second relative position towards the first relative position, the wristband of the wrist watch becomes taut around the support, thereby holding the wrist watch securely in place.

2. A display stand as defined in claim 1 wherein the connecting member comprises a generally V-shaped resilient member, and wherein the resiliency of the generally V-shaped resilient member comprises the means to urge the first contact area and the second contact area towards the first relative position.

3. A display stand as defined in claim 2 wherein the generally V-shaped resilient member includes a vertex, the vertex defining the third contact area.

4. A display stand as defined in claim 1, wherein the first contact area and the second contact area are curvilinear.

5. A display stand as defined in claim 4 wherein the curvilinear first contact area and the curvilinear second contact area are generally cylindrical.

6. A display stand as defined in claim 5 wherein said base portion comprises a first engaging member adapted to mate with a corresponding female engaging member recessed into a display tray.

7. A display stand as defined in claim 5 wherein said base portion comprises a female engaging member adapted to receive a corresponding male engaging member protruding from a display tray.

8. A display tray comprising a plurality of display stands as defined in claim 6.

* * * * *